US005579365A

United States Patent [19]

Jacobs et al.

[11] Patent Number: 5,579,365

[45] Date of Patent: Nov. 26, 1996

[54] SNAP-IN COLLIMATOR DEVICE

[76] Inventors: Raymond G. Jacobs, 27080 Ridge Rd., Wauconda, Ill. 60084; Douglas A. Barnett, 2980 SW. 122nd Ave., Beaverton, Oreg. 97005

[21] Appl. No.: 223,289

[22] Filed: Apr. 5, 1994

Related U.S. Application Data

[63] Continuation of Ser. No. 177,592, Jan. 5, 1994, abandoned.

[51] Int. Cl.[6] ..... G21K 1/02

[52] U.S. Cl. ..... 378/147; 378/145

[58] Field of Search ..... 378/147, 145

[56] References Cited

U.S. PATENT DOCUMENTS

| | | | |
|---|---|---|---|
| 3,745,344 | 7/1973 | Updegrave . | |
| 3,864,576 | 2/1975 | Stevenson . | |
| 4,166,220 | 8/1979 | Stutts | 378/147 |

OTHER PUBLICATIONS

RINN Corporation catalog for 1990, author unknown, pp. 1, 2, 18, 19 and 31 (the last page of catalog).

*Primary Examiner*—Craig E. Church

[57] ABSTRACT

For use with dental position indicating devices for dental x-ray machines that are collimated and are of round transverse cross sectional configuration defining a bore for the length of same, with such bore having its internal surfacing lined for x-ray absorption and having an x-ray emitting end, a snap-fit collimator device therefor for use with rectangular dental instrumentation that is in the form of a body providing a collimator of rectangular form in the size of such instrumentation, with the body being arranged for snap-fit mounting of same on the x-ray emitting end of such round type position indicating devices, with the arrangement involved providing for rotational adjustment of said body relative to such position indicating device for permitting the collimator of same to be aligned with rectangular dental instrumentation, when the position indicator device in question is secured to an x-ray machine in the course of practicing dental radiography.

6 Claims, 2 Drawing Sheets

SNAP-IN COLLIMATOR DEVICE

This application is a continuation of Raymond G. Jacobs application Ser. No. 08/177,592, filed Jan. 5, 1994 abandoned.

BACKGROUND OF THE INVENTION

This invention relates to the subject of what is known in the dental field as "position indicating devices" for dental x-ray machines (which are aim known in the art as "PIDS"), and more particularly to a collimator device arranged for "snap-in" application to position indicator devices of the round type that are otherwise collimator equipped.

Dental x-ray machines conventionally are equipped with a so-called position indicating device (hereinafter referred to as a "PID") that is used for both limiting the size of a usual x-ray beam employed in exposing the x-ray film located within the patient's mouth, and to facilitate the alignment of the x-ray beam with the x-ray film that has been previously located in the patient's mouth by the practice of the usual dental technology. Commercially, PIDS are constructed for removable application to the x-ray machine that is available to the dentist (who is practicing the dental technology involved), and at the present time there are numerous ways to secure a PID to such x-ray machine).

During the use of the dental x-ray machine in the practice of dental radiography, when the dentist practicing the dental radiography involved uses rectangular instrumentation to take his x-ray photos, the PID must not only be collimator equipped, but it must also be of the rotatable rectangular type so as to permit the dentist to dispose the PID in alignment with the position of the short and long dimensions of the x-ray film that previously has been appropriately mounted in the patient's mouth, due to the fact that such positioning of the film will vary, depending on, for instance, whether posterior or anterior film holding instruments are being employed. A PID of this type is disclosed in U.S. Pat. No. 3,864,576, granted Jan. 4, 1975 (the entire disclosure of which is incorporated herein by this reference).

The present invention is concerned with equipping what is now the conventional round PID with a relatively small collimator of rectangular shape so that in addition to the collimation provided for, the benefits of a rectangular collimator are obtained even though the dentist does not have access to a rectangular collimator, as such.

A principal object of the invention is to provide a relatively small rectangularly configured, rotatably mounted, collimator device that may be snap-fit applied to the x-ray emitting end of standard circular PIDS, and by the dentist practicing the dental radiology involved, so that not only is collimation provided for, but also the preferred rectangular instrumentation may be employed in connection with the making of photos of the patient's teeth that the dentist wishes to take.

Another object of the invention is to provide a snap-in collimator device for application to round PIDS at the x-ray emitting end of same, so that the resulting assembly provides the benefits of a collimator equipped, rectangular, PID.

SUMMARY OF THE INVENTION

In accordance with the invention, a snap-fit, rotatably mounted, collimator device that permits the use of rectangular dental instrumentation by the dentist who has no rectangular PID, with such improved collimator device being arranged for snap-fit application to the x-ray emitting end of round type PIDS (that are otherwise equipped for collimation as is well known in the art); round PIDS each conventionally include a bore of round transverse cross sectional configuration that, in one commercially available form, has its internal surfacing lined for x-ray absorption and, in addition to its usual x-ray emitting end, has the usual x-ray collimating and receiving end, which is also arranged for appropriate connection to the dentist's x-ray machine. The indicated snap-fit collimator device of this invention includes a body of rectangular form in a size that corresponds to the size of the rectangular instrumentation that is to be used by the dentist (in practicing dental radiography in connection with a particular patient), with such collimator being arranged for use universally in connection with all commercially available PIDS; in the illustrated form, the collimator body includes resilient fingers or legs that can be inserted in contracted relation within the bore of the PID employed by the dentist, and which resiliently expand against the PID bore surfacing to resiliently grip same and permit the collimating body of the device in question to be firmly disposed against the PID x-ray emitting end. The device collimating body, in accordance with this invention, also is arranged to permit full rotational adjustment of same relative to the PID for permitting the indicated improved collimator device to be aligned with the rectangular dental instrumentation that normally has already been put into place by the dentist, so that the resulting assembly of the indicated conventional round PID and the snap-fit collimator device of the present invention may be appropriately "aimed" at the patient's target area to be x-rayed, in connection with the practice of dental radiology.

Other objects, uses, and advantages will be obvious or become apparent from a consideration of the following detailed description and the application drawings in which:

BRIEF DESCRIPTION OF DRAWING FIGURES

FIG. 1 is a diagrammatic side elevational view of one form of the improved snap-fit collimator device, showing same as it might be arranged for application to a conventional round PID of reduced diameter (for instance, the 2⅜ inch (60 mm.) diameter variety), with the body involved being shown partially in section, and with one of the body PID gripping legs being broken away to expose the gripping leg behind it;

Figures 1, 1A, 2, 3, 4, 5, 6:
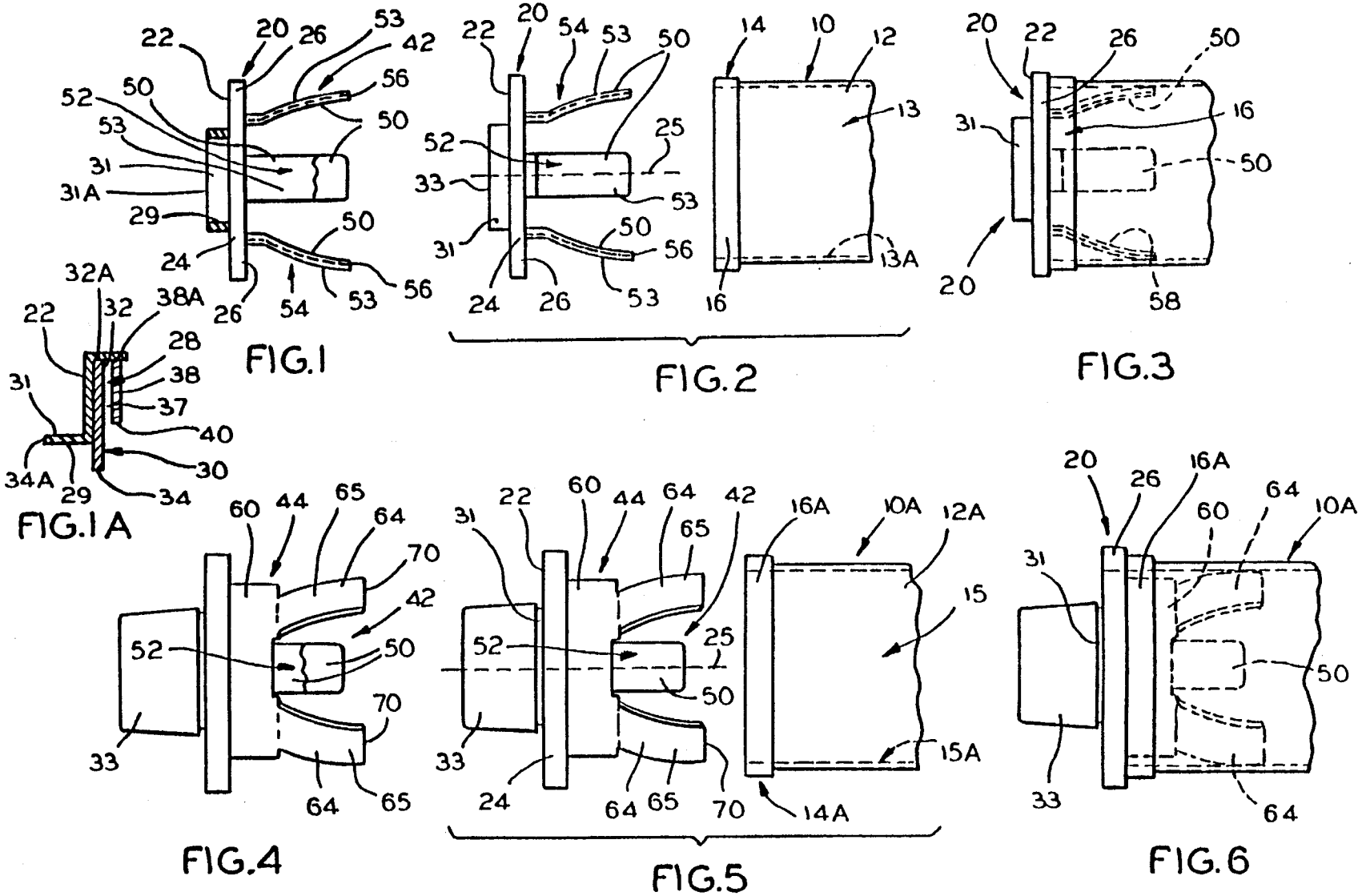
FIG. 1A is a diagrammatic and fragmental sectional view of one side of the collimator body (that is shown in FIG. 1), illustrating the x-ray beam defining aperture of the improved device collimator, and the x-ray beam accommodating aperture of the improved device body at its front.
FIG. 2 is a side elevational view of the collimator device of FIG. 1 positioned adjacent the x-ray emitting end of a conventional round PID for mounting on same.
FIG. 3 is a side elevational view showing the collimator device of FIG. 1 snap-fit applied to the x-ray emitting end of the conventional round PID shown in FIG. 2.
Figure 7:
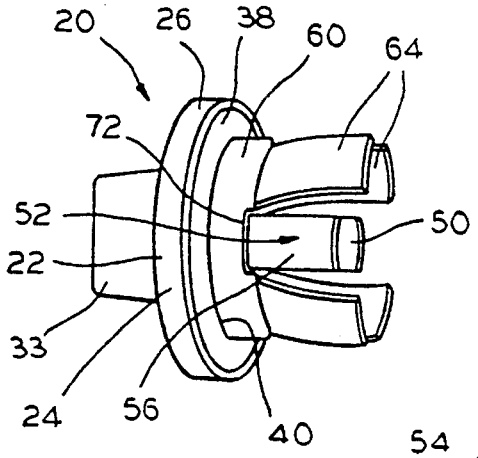
Figure 8:
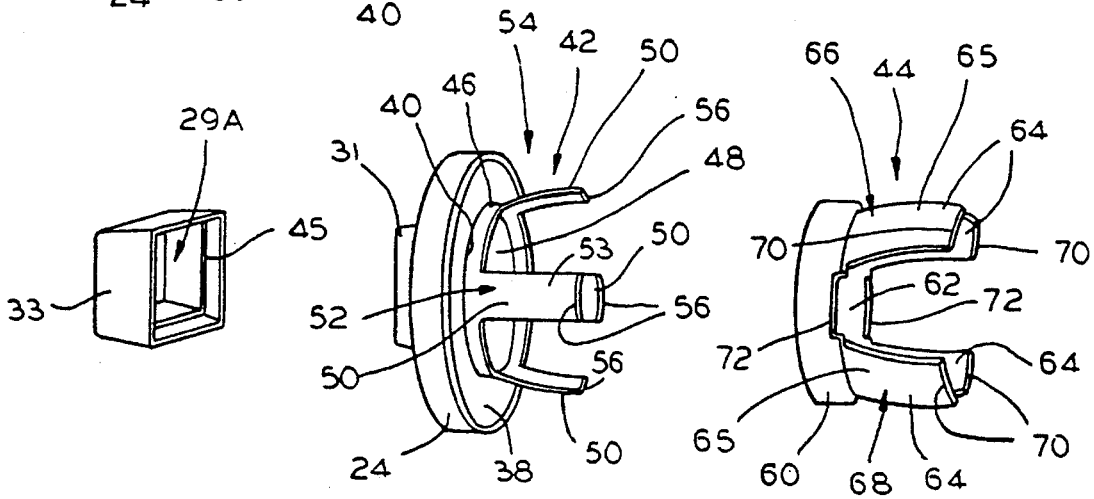
Figure 9:
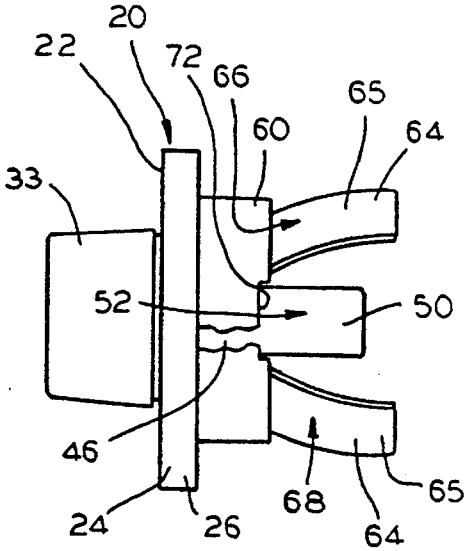
Figure 10:
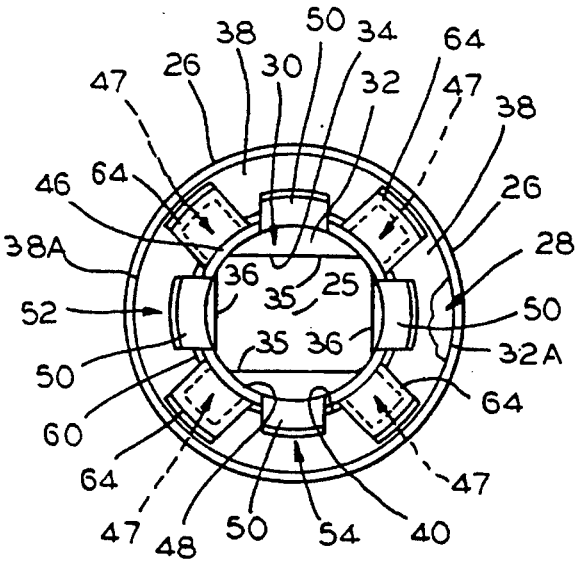

FIG. 4 is a side elevational view of the collimator device shown in FIGS. 1–3, equipped to be snap-fit mounted in the same way but in a larger diameter conventional round PID (for instance, a round PID of 2¾ inch (70 mm.) diameter), with the collimator device itself being shown equipped at its front with an extension, where the dental photographs to be taken by the dentist requires this in the dentist's practice of dental radiography, and with one of the legs of the collimator device involved that is the subject of FIG. 1 being broken away in a manner similar to what is employed in FIG. 1;

FIG. 5 shows the collimator device arranged as shown in FIG. 4 disposed for snap-fit application to the indicated larger diameter round PID;

FIG. 6 is a side elevational view illustrating the collimator device arranged as shown in FIG. 4 snap-fit mounted on the x-ray emitting end of the larger diameter round PID shown in FIG. 5 to equip such PID for use in the practice of dental radiology using rectangular instrumentation;

FIG. 7 is a perspective view of the collimator device of this invention as shown in FIG. 4, taken from the side of such device that is shown in FIG. 4;

FIG. 8 is an exploded perspective view of the collimator device of FIGS. 4 and 7, taken from the same position as indicated in FIG. 7;

FIG. 9 is a larger scale view of the collimator device equipped as shown in FIG. 4, with the device second adapter ring (see FIG. 8) shown broken away to expose the device first adapter ring; and FIG. 10 is a view of the collimator device as shown in FIG. 9, taken from the right hand end of same, better illustrating the device collimator plate itself, the collimator plate aperture through which the x-ray beam is to pass through the collimator plate, and thus through the collimator device itself to the patient's target area to be x-rayed, and showing as well the nature of the resilient legs of the two sets of same that are provided by the collimator device of FIGS. 4 and 9 (again, see FIG. 8).

However, it is to be distinctly understood that the specific drawing illustrations provided are supplied primarily to comply with the requirements of the Patent Laws, and that the invention may have other embodiments that will be obvious to those skilled in the art, and which are intended to be covered by the appended claims.

BASIC DESCRIPTION

Referring now more particularly to the drawings, reference numeral 10 of FIGS. 2 and 3 indicates a conventional round PID that comprises the usual cylinder 12 defining a bore 13 that is equipped with surfacing 13A for the length of same (PID 10 may have surfacing 13A suitably defined by lead lining, or the plastic material from which PID 10 is formed may have x-ray absorbing material contained therein, both of which are conventional practices). The PID 10 has the usual collimated x-ray beam receiving end that is not illustrated and the usual x-ray emitting end 14 to which is shown applied the usual suitable end cap 16 (the conventional bore 13 of the round PID 10, as indicated, is round in transverse cross sectional configuration, as is common for conventional round PIDS of the type illustrated in FIGS. 2–3 and 5–6).

The basic snap-fit collimator device 20 of the invention is shown in FIGS. 1–3, and in addition to the improvements provided by device 20, device 20, in accordance with the invention, is arranged for snap-fit application (of the collimating device 20) to the x-ray emitting end 14 of the round PID 10, with the result that the device 20 as mounted on the PID 10 provides for rectangular collimation of the initially transverse rounded x-ray beam, as well as rotation of the collimator aperture involved for appropriate centering with respect to rectangular instrumentation that has been employed by the dentist in connection with his practice of dental radiology for a particular patient.

In the form illustrated, the device 20, as indicated, is arranged to be snap-fit applied to the x-ray beam emitting end 14 of the PID 10, and also the device 20 is arranged for snap-fit application to the larger size PID 10A that is diagrammatically illustrated in FIGS. 5 and 6, with the showing involved in FIGS. 5 and 6 illustrating the end cap 16A of the larger PID 10A, as well as indicating its bore 15A and the internal surfacing 15B of the bore 13A.

For the purpose of making collimator device 20 snap-fit applicable to both of the respective PIDS 10 and 10A, the device 20 includes a first set 42 of resilient legs or fingers, and a second set 44 of the same type of resilient legs or fingers, which in both cases are intended to resiliently grip the respective internal surfacings 13A and 15A of the respective PIDS 10 and 10A, as will be described hereinafter.

As indicated in the drawing Figures, the collimator device 20 comprises a disc-like body 22 that defines a circular periphery 24, which is circularly arcuate about an imaginary axial center 25; the body 22 defines rim portion 26 that extends rearwardly of the said body 22 (and its center axis 25), so that the body 22 is actually of cup shaped configuration (defining a cup shaped socket or recess 28, see FIGS. 1A and 10), and fixedly receives in same a collimator 30 in the form of collimator plate 32 and annular retainer member 38 (see FIGS. 1A and 10). As indicated in FIG. 10, the collimator plate 32 (which may be formed from lead or its equivalent) also defines the improved collimator basic x-ray beam emitting rectangular aperture 34 that is preferably of the same size of the film that is involved in the rectangular instrumentation procedures being pursued by the dentist. As indicated in FIG. 10, the collimator plate 32, which is circular (it having a rim 32A that is of the same diameter as internal diameter of rim 38A of retainer member 38) is centered with regard to axis 25, and its aperture 34 is basically rectangular in configuration, including the pair of opposed long sides 35 and a pair of opposed short sides 36 that at the corners of the aperture 24 merge into the same curvature that the similarly shaped film (to be exposed by these dental radiograph procedures) have. The body collimator plate 32 and the indicated annular retainer member 38 are both in fixed relation to the body 22, and in the spaced apart relation that is shown in FIG. 1A, for these parts to provide an operating space 37 therebetween for the purpose of permitting the body 22 to be rotated about the axis 25, so as to bring the aperture 34 of the collimator plate 32 into full coinciding alignment with the film being processed; as indicated, this positioning will vary depending on whether posterior or anterior film holding instruments are involved in the dental radiograph procedures being practiced.

The body 22 thus defines the cup shaped socket or recess 28 (see FIGS. 1A and 10) for the purpose of receiving the indicated collimator plate 32 and the retainer member 38, both of which may be fixed with respect to the body 22 in any suitable manner (for instance, for this purpose the internal diameter surfacing of rim 26 of the body 22 may be formed with four equally spaced bosses extending the length of the rim 26, and the plate 32 and retainer member 38 suitably notched in corresponding locations, for press fitting of these components into fixed relation with the body 22).

The body 22 is formed with its own x-ray beam passing aperture 29 (see FIGS. 1 and 1A), which is proportioned to be of the same shape as the collimating plate aperture 34, but is somewhat larger about its periphery. The body 22 is also shaped to define the extending ridge or flange 31 that is continuous thereabout and that terminates at edging 31A; the ridge or flange 31 is proportioned to have the configuration of aperture 29 (the latter, as indicated, having the configuration of the aperture 34, but as indicated, being somewhat larger).

The collimator device 20 also includes the aforementioned sets of legs or fingers 42 and 44. With regard to the set 42, the device 20 mounts sleeve 46 within aperture 40 of the annular retainer 38 (see, for instance, FIGS. 1A and 10), with the sleeve 46 being positioned to dispose the spaced flanges 47 involved (four are illustrated in FIG. 10), that are integral therewith, in the operating space 37 that is defined within the body 22 by the collimator plate 32 and annular retainer 38 in the fixed relation of the latter two components within such recess 28. It is preferred that the indicated flanges 47 of the sleeve 46 be integral therewith and that they be shaped to permit the body 22 to be rotated at least 360 degrees (360°) about the axis 25 without any movement axially of the axis 25.

As indicated, in FIGS. 1, 2, and 8, the sleeve 46 is also provided with generally rearwardly extending legs or fingers 50 that are shaped as indicated to provide the respective camming surfaces 53 that, for application of the body 20 to the smaller PID 10, may be deflected (as toward axis 25) adjacent their ends 56 and inserted into the x-ray emitting end 14 of PID 10; upon release, the cam surfaces 53 of the respective legs or fingers 50, adjacent their ends 56, resiliently engage the internal surfacing 13A of the PID 10, with the body 22 then being moved to and against the end cap 16 of the said PID 10, to dispose the device 20 in full operating position with respect to the PID 10. In the form shown for set 42, the legs or fingers 50 comprise opposed pair 52 and opposed pair 54 that are the same in number and configuration.

The second set 44 of resilient legs or fingers that adapts the collimator device 20 for application to the larger PID 10A comprises (see FIG. 8) a sleeve 60 defining a bore 62 as well a number of integral legs or fingers 64 that are arranged similar to the legs or fingers 50 of the set 42, with the sleeve 60 being proportioned insofar as its bore 62 is concerned for slip type cam fitting over the legs or fingers 50 (of set 42) in the manner contemplated by this invention (see, for instance, FIGS. 7, 9, and 10).

Thus, as indicated in FIGS. 5 through 8, in order to arrange the device 20 for application to the larger PID 10A, the sleeve 60 and specifically its bore 62 are proportioned for slip type cam fitting over the fingers 50 of the set 42, and for this purpose, the legs or fingers 50 are deflected toward axis 25 as needed to pass the sleeve 60 over the legs or fingers 50 and dispose the sleeve 60 adjacent the indicated annular retainer 38, with the cam surfaces 53 of the fingers or legs 50 being shaped and then disposed to bias the sleeve 60 against the said member 38. As so arranged, with the set 44 applied to the set 42 of the device 20, the legs 64 of the second set 44 are disposed so that their exterior cam surfacings 65 are arcuately disposed for application to the internal surfacing 15A of the PID 10A in the same manner as provided for in connection with the application of the legs or fingers 50 of the set 42 to the internal surfacing 13A of PID 10 (see FIGS. 3 and 6); the device 20 with the set 44 applied thereto may also be applied to the x-ray emitting end 14A of the PID 10A so that the body 22 abuts the end cap 16A (of said PID 10A) to mount the device 20, again, in its operative position on PID 10A. As in the case of set 42, the legs or fingers 64 of set 44 thus comprise opposed pair 66 and opposed pair 68 that are the same in number and configuration, and define ends 70 and cam surfaces 65; the legs or fingers 64 are shaped for application of the body 20 to the wider PID 10A in the same manner as described with respect to legs or fingers 50. Upon release after initial deflection (toward axis 25) that may be required to apply the device 20 to PID 10A, the cam surfaces 65 of the respective legs or fingers 64, adjacent their ends 70, resiliently engage the surfacing 15A of the PID 10A, with the body 22 then being moved to and against the end cap 16A to dispose the device 20 in full operating position to the PID 10A.

As indicated in FIG. 8, the device 20 may be equipped with a tabular extension 33; the extension 33 (see FIG. 8) is recessed as at 45 for reception over the rectangularly shaped ridge 31 and is proportioned internally to provide a continuation aperture 29A of the aperture 29 of the body 22. For some embodiments, the extension 33 may be desirable. It is known, for instance, that some manufacturers of x-ray machines have in their equipment time, milliamperage, and kilovoltage settings that are pre-set; for those manufacturers that can vary these settings, the extension 33 makes the device 20 easier to position and use without affecting radiograph quality (for this purpose, the extension 33 as applied to body 22 should be one inch in length, for best results).

It will further be observed that the sleeve 60 of the set 44 is also recessed as at 72 between its pairs of legs or fingers 66 and 68 to receive the legs or fingers 50 (of the set 42) in a snap-fit manner, which provides a biasing of the sleeve 60 against the retainer 38.

The body 20, extension 33, retainer 38, and sets 42 and 44 (including their respective legs or fingers) may be injection mold formed from a suitable plastic material, such as ABS or its equivalent that may be colored black or any other selected color.

The device as shown in FIGS. 6–10 may be employed as a whole to apply body 22 to round PIDS that are of European manufacture or are made elsewhere; while the set 44 may have to be removed to snap-fit mount body 22 on some of such PIDS, the proportioning of the legs or fingers of devices 42 and 44 is such that the combination shown in FIGS. 6–10 renders device 20 useful universally on all commercially available PIDS, and that device 20 should be made available to dentists that work with such PIDS or their equivalents.

The foregoing description and the drawings are given merely to explain and illustrate the invention, and the invention is not to be limited thereto, except insofar as the appended claims are so limited, since those skilled in the art who have this disclosure before them will be able to make modifications and variations therein, without departing from the scope of the invention.

We claim:

1. In a position indicating device for dental x-ray machines, which device is of round transverse cross sectional configuration defining a bore for the length of same, with such bore having its internal surfacing lined for x-ray absorption and having its own collimation and an x-ray emitting end, a snap-fit collimator device therefor for use with rectangular dental instrumentation, said device comprising:

a body providing a collimator of rectangular form in the size of such instrumentation;

means for snap-fit mounting said body on such x-ray emitting end of the position indicating device with said collimator disposed transversely of and centered on the position indicating device bore, wherein said means for said snap-fit mounting of said body on such x-ray emitting end of the position indicating device is formed from plastic material and includes similar integral legs spaced to resiliently and frictionally engage said positioning indicating device about the bore thereof and permit said body to be seated in abutting relation to x-ray emitting end of said position indicating devices; and means for permitting full rotational adjustment of said body relative to the position indicating device for permitting said collimator of said body to be aligned with such rectangular dental instrumentation when such position indicator device is secured to an x-ray machine.

2. The collimator device set forth in claim 1, wherein:

said means for snap-fit mounting of said body on such x-ray emitting end of the position indicating device includes one set of similar legs spaced to engage a position indicating device of one predetermined diameter about the bore thereof, with said means including a second set of similar legs spaced to engage a position indicating device of a second predetermined but different diameter, both of said sets of legs permitting said body to be seated in abutting relation to the x-ray emitting end of either of such position indicating devices.

3. A method of equipping a round position indicating device for use between a dental x-ray machine and rectangular dental instrumentation, which includes snap-fitting on the x-ray emitting end of such position indicating device a rectangular collimator, and disposing the collimator to correspond with the position of the dental instrumentation when dental radiography is to be practiced, said method including varying said snap-fitting to accommodate round position indicator devices of variant diameters.

4. For application to a round position indicating device for dental x-ray machines, which device defines a bore that is round for the length of same, with such bore having its internal surfacing lined for x-ray absorption and having its own collimation and an x-ray emitting end through which a dental x-ray beam extends when such position indicating device is operatively applied to such dental x-ray machine for practicing dental radiography, a snap-fit rectangular collimator therefor for use in practicing rectangular dental instrumentation using said device and adapted to be snap-fit applied to such x-ray emitting end of such device, said collimator comprising:

a planar circular body defining a circular periphery having a circular rim projecting a predetermined amount opposite to the direction of such x-ray beam through such device bore, and defining a cupped shaped recess, a collimator fixedly mounted in said recess and defining an aperture of right rectangular configuration that is centered on the center of said body and is dimensioned for said practice of said rectangular dental instrumentation, said body defining an aperture that is shaped to exceed the dimensioning and shaping of said collimator aperture and having a continuous rim about said body aperture that extends a predetermined amount in the direction of such x-ray beam, said body having fixed thereto within said cupped shaped recess an annular retainer having an inner aperture defined by a diameter of a dimension that exceeds the dimension of the long side of said collimator aperture, a sleeve disposed within said inner annular retainer inner aperture, said sleeve defining a bore that is of a dimension that at least equals the dimension of the long side of said collimator aperture, said sleeve being rotatable with respect to said body at least 360 degrees (360°) relative to said body, means for holding said sleeve against movement longitudinally of such x-ray beam, and, with said sleeve having secured thereto a set of resilient legs that project from said sleeve substantially oppositely of said rim and that are spaced about said sleeve in opposed pairs that at their projecting ends of such pairs are opposed for deflection for insertion of said legs through and into said device x-ray emitting end and resilient biasing of same against the internal surfacing of said device bore to operatively mount said collimator on said device for said practice of dental radiography, whereby said body rim may be disposed in abutting relation with such device and, said body may be rotated 360 degrees (360°) relative to said device for disposing said collimator for the practice of rectangular dental instrumentation.

5. The collimator as set forth in claim 4, including:

a second set of resilient legs secured to a second sleeve that also project from said second sleeve substantially oppositely of said rim that are also spaced about said second sleeve in opposed pairs that have their projecting ends spaced for said deflection of said second legs for insertion into and resilient biasing against the bore of said device that is of larger transverse dimension, with such second sleeve being seated against said annular retainer and being in concentric relation relative to the first mentioned sleeve, to operatively mount said collimator on such larger dimensioned device for said practice of dental radiography, whereby said body rim may be disposed in abutting relation with such larger dimensioned device, and said body may be rotated 360 degrees (360°) relative to such larger dimensioned device for disposing said collimator for said practice of rectangular dental instrumentation.

6. The collimator set forth in claim 4, including:

an extension component arranged for slip fit mounting on said aperture continuous rim, said extension component being proportioned internally to provide a continuation of said body aperture in the practice of dental radiography.

* * * * *